US006279447B1

(12) United States Patent
Beal

(10) Patent No.: US 6,279,447 B1
(45) Date of Patent: Aug. 28, 2001

(54) METHOD FOR THE MANUFACTURE OF GUN AMMUNITION HAVING ELONGATED PROJECTILE AND A CARTRIDGE PRODUCED THEREBY

(75) Inventor: Harold F. Beal, Rockford, TN (US)

(73) Assignee: Cove Corporation, Rockford, TN (US)

( * ) Notice: Subject to any disclaimer, the term of this patent is extended or adjusted under 35 U.S.C. 154(b) by 0 days.

(21) Appl. No.: 09/166,345

(22) Filed: Oct. 5, 1998

(51) Int. Cl.[7] ..... F42B 33/02; F42B 5/02
(52) U.S. Cl. ..... 86/29; 86/23; 102/434
(58) Field of Search ..... 102/430, 433, 102/434, 439; 86/23, 29–33

(56) References Cited

U.S. PATENT DOCUMENTS

Re. 3,833 * 2/1870 White .
2,971,426 * 2/1961 Potts .
3,137,198 * 6/1964 Potts .
4,689,185 * 8/1987 Lopata et al. .
4,846,068 * 7/1989 Zedrosser ..... 102/430

FOREIGN PATENT DOCUMENTS

380586 * 9/1964 (CH) ..... 102/430
409705 * 10/1966 (CH) ..... 102/439
18238 * 6/1882 (DE) ..... 102/434
327188 * 6/1936 (IT) ..... 102/439
378355 * 6/1940 (IT) ..... 102/439

* cited by examiner

*Primary Examiner*—Peter M. Poon
*Assistant Examiner*—Son T. Nguyen
(74) *Attorney, Agent, or Firm*—Pitts & Brittian, P.C.

(57) ABSTRACT

A method for the manufacture of a gun ammunition cartridge including multi-stage insertion of a projectile into a case a distance beyond the inboard terminal end of the neck of the case without deleterious effect upon the gun powder disposed within the case. Substantially full utilization is achieved of the interior volume of the case that is available for the receipt of gun powder.

4 Claims, 2 Drawing Sheets

METHOD FOR THE MANUFACTURE OF GUN AMMUNITION HAVING ELONGATED PROJECTILE AND A CARTRIDGE PRODUCED THEREBY

BACKGROUND OF INVENTION

This invention relates to the manufacture of gun ammunition (cartridges) which include a case having a closed end which houses a primer and an open end, gun powder disposed within the case, and a projectile secured in the open end of the case.

Gun ammunition, known also as cartridges, are of standardized dimensions for a given caliber gun. These standards are set by the Sporting Arms and Ammunition Manufacturers Institute (SAAMI). For those guns which operate in the automatic or semi-automatic mode, the overall length (OAL) of the cartridge is critical to the successful operation of the mechanism which feeds the cartridge from a magazine into the breech of the gun. Further, maximization of impact energy of the projectile upon striking a target dictates that the projectile be of maximum weight. Any given projectile desirably travels from the gun muzzle to a target with the longitudinal centerline of the projectile aligned with the trajectory of the projectile, that is, the projectile exhibits stability of flight from the gun muzzle to its target. A projectile can be overstabilized or understabilized. Among the many factors which affect the stability of a projectile in flight are the spin effects created by firing the projectile from a rifled gun barrel, precession (i.e. yaw about the center of gravity of the projectile), nutation (another movement inside the precession), and wind effect. The wind effect may be reduced toward a minimum by making the projectile heavier, such as by fabricating the projectile from a heavy metal such as tungsten. Increasing the length of the projectile also can increase the overall weight of the projectile (for a given caliber).

As noted, the size (geometry), including the length of a cartridge case is established by the standards set in the industry so that any given caliber ammunition cartridge will be received within the firing chamber of any gun of such given caliber. Thus, if one chooses to increase the length of the projectile of such caliber cartridge, and also desires to maintain the OAL of the cartridge within a given range, the only place the extra length of projectile can go is within the case. Thus, the "extra" length of the projectile takes up space within the interior of the case which normally would be available for gun powder. In order for the heavier projectile to be fired from the gun at a given muzzle velocity, it is required that the gun powder be chosen to accommodate the heavier projectile, both from the standpoint of the increased weight of the projectile and the fact that there is less volume within the case for gun powder. In any event, it becomes desirable that there be a maximum amount of gun powder loaded into the case (along with the trailing end of the projectile).

In the manufacture of gun ammunition, it is common practice to support the case in an upright position with its open end facing upwardly, introduce a measured quantity of gun powder into the case, and thereafter insert the trailing end of a projectile into the open end of the case. Most commonly, the open end of the case is crimped about the circumference of the projectile to anchor the projectile in the case. This prior art practice is acceptable where the length of the projectile is such that very little, of any, of the length of the projectile projects into the interior of the case beyond the inboard terminal end of the neck of the case. But where any material portion of the length of the projectile projects into the interior of the case beyond the inboard terminal end of the neck of the case, there is formed an annular space between the outer surface of the projectile and the inner surface of the case. When employing conventional methods for inserting projectiles into cases, this annular space is devoid of gun powder. This factor exacerbates the problems of choice of the type of gun powder and the volume of gun powder which can be added to the case.

It is of importance to note that the individual particles of a commercial gun powder are deliberately sized and of a geometry as will produce a given result when ignited within a cartridge case. Specifically, the individual particles of a given gun powder may be flakes, balls, non-perforated grain (cylindrical), single perforated grain (tubular), or multi-perforated grain, for example. Each shape is designed to provide a given burn rate for each powder particle, which in turn develops a collective distinctive gas pressure curve for each type of gun powder. This burn rate and resulting gas pressure curve are critical for developing a given muzzle velocity for a given projectile from a gun. Any destruction, even partial, of the shape of particles of the gun powder will alter the gas pressure curve of a given charge of the gun powder. Accordingly, it is not permissible when loading a projectile in a case, that the projectile be forced into contact with the powder particles such as will even partially destroy the shape of the particles. For this reason, when inserting a projectile into a case such that the trailing end of the projectile projects into the case beyond the inboard terminal end of the neck of the case, it is not permissible to allow the trailing end of the projectile to contact the gun powder, which is already in the case, with a force which will destroy the shape of the gun powder particles. Thus, it will be recognized that it is not permissible to urge the projectile into contact with the gun powder in the case to the extent that the projectile displaces the gun powder radially outwardly and upwardly of and within the case in an attempt to cause the gun powder to be displaced into an annular space between the projectile and the case. Heretofore, this factor has acted as a limit to the permissible length of a projectile for a given caliber cartridge and has limited full utilization of the volume available within the case for receiving gun powder when using longer projectiles.

BRIEF DESCRIPTION OF THE FIGURES

The present invention has as an object the provision of a method for the manufacture of gun ammunition cartridges wherein there is maximization of the permissible length of the projectile of each cartridge and full utilization of that interior volume of the case which is not occupied by the projectile.

Other objects and advantages of the present invention will be recognized by one skilled in the art from the description given herein, including the claims and the drawings, in which:

SUMMARY OF INVENTION

Figure 1:
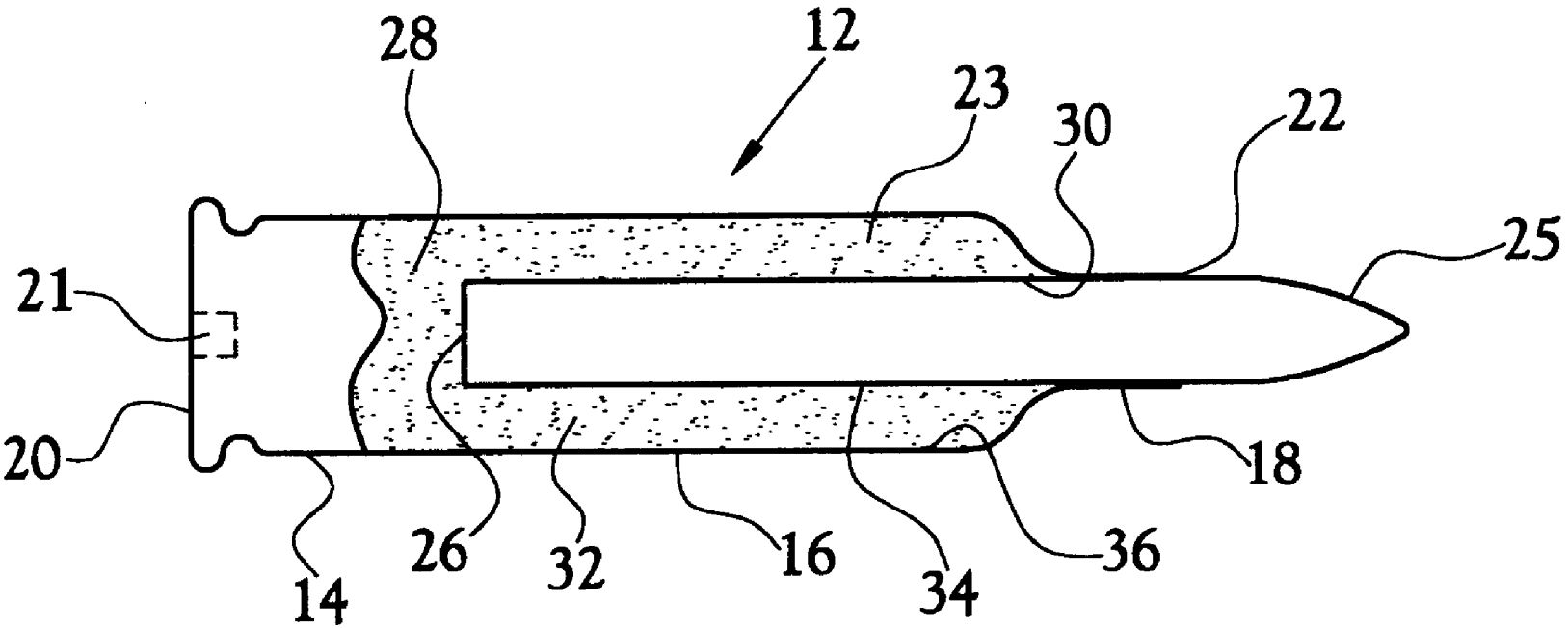
FIG. 1 is a representation, partly in section, of a gun ammunition cartridge manufactured in accordance with the present invention.

In accordance with one embodiment of the method of the present invention, an ammunition cartridge case is mounted upright with its open end directed upwardly. A measured quantity of gun powder is admitted to the case. Thereafter, a generally cylindrical projectile having a length sufficient to cause a substantial portion thereof to project inwardly into the case beyond the inboard terminal end of the neck of the case when the projectile is fully seated in the case, is inserted into the case a distance which causes the trailing end of the projectile to terminate short of contact with the powder charge within the upright case. Thereupon, the case is inverted, causing a portion of the powder charge to flow by gravity downwardly into, and to fill a portion of the annular space between the outer surface of the projectile and the inner surface of the case. Remaining powder from the initial powder charge lies loosely above the trailing end of the projectile and in the open space between the projectile and the closed end of the case. Thereafter, and while the case remains inverted, the projectile is further inserted into the case to the extent required to develop the desired overall length of the cartridge. This action pushes the trailing end of the projectile toward the closed end of the case, causing lateral displacement of the powder into the annular space between the projectile and the case as the projectile is moved further into the case. That portion of the powder charge which does not enter the annular space between the projectile and case is pushed gently upwardly to cause the powder to substantially fill the case and thereby be in excellent position for ignition upon firing of the primer of the cartridge. As desired, the outboard end of the neck of the case is crimped against the circumference of the fully seated projectile to anchor the projectile within the case. The quantity of the gun powder admitted to the case is initially calculated to substantially fill the void volume between the projectile and the case when the projectile is fully seated within the case. Employing the "two-stage" seating of the projectile to obtain the desired full seating of the projectile within the case, precludes the projectile from being forced into such contact with the powder particles as will destroy or alter their individual particulate shapes. As a result, the gas pressure curve of the gun powder, when ignited by the firing of the gun, is a known and unaltered entity, thereby resulting in the desired and intended muzzle velocity of the projectile as it is propelled from the gun. Further, the present method results in uniformity of firing from cartridge to cartridge. This uniformity of firing has been found to be obtained by cartridges manufactured in accordance with the present invention, irrespective of whether the intended muzzle velocity of the projectile be subsonic or supersonic.

DETAILED DESCRIPTION OF INVENTION

With reference to the Figures, a gun ammunition cartridge 12 manufactured in accordance the present method includes a case 14 having a generally cylindrical body portion 16, a neck 18, a closed end 20 which houses a primer 21, and an open end 22. A measured quantity of gun powder 23 is contained within the case and a projectile 24 is disposed within, and closes the open end of the case. In the depicted cartridge, the projectile is generally cylindrical and provided with an ogive at the leading end 25 thereof. The trailing end 26 of the projectile projects inwardly into the interior cavity 28 of the case by a substantial distance inwardly beyond the inboard terminal end 30 of the neck. When so positioned within the case, there is defined an annular space 32 between the outer surface 34 of that portion of the projectile which is disposed within the interior volume of the case, and the inner wall surface 36 of the case. This annular space is substantially filled with the gun powder 23, as is the space 37 between the trailing end 26 of the projectile and the closed end 20 of the case. To this end, the quantity of gun powder initially introduced into the case is selected to occupy all or at least a maximum portion of that interior space (volume) of the case which is not occupied by the projectile. As will be recognized by one skilled in the art, the caliber of the cartridge, the weight of the projectile, the desired muzzle velocity of the fired projectile, and the total interior volume of the case, among other things, must be taken into consideration in determining which type of powder, and what quantity thereof, is to be introduced into the case in order to maintain SAAMI pressures for a given weapon.

Figures 2A, 2B, 2C, 2D, 2E:
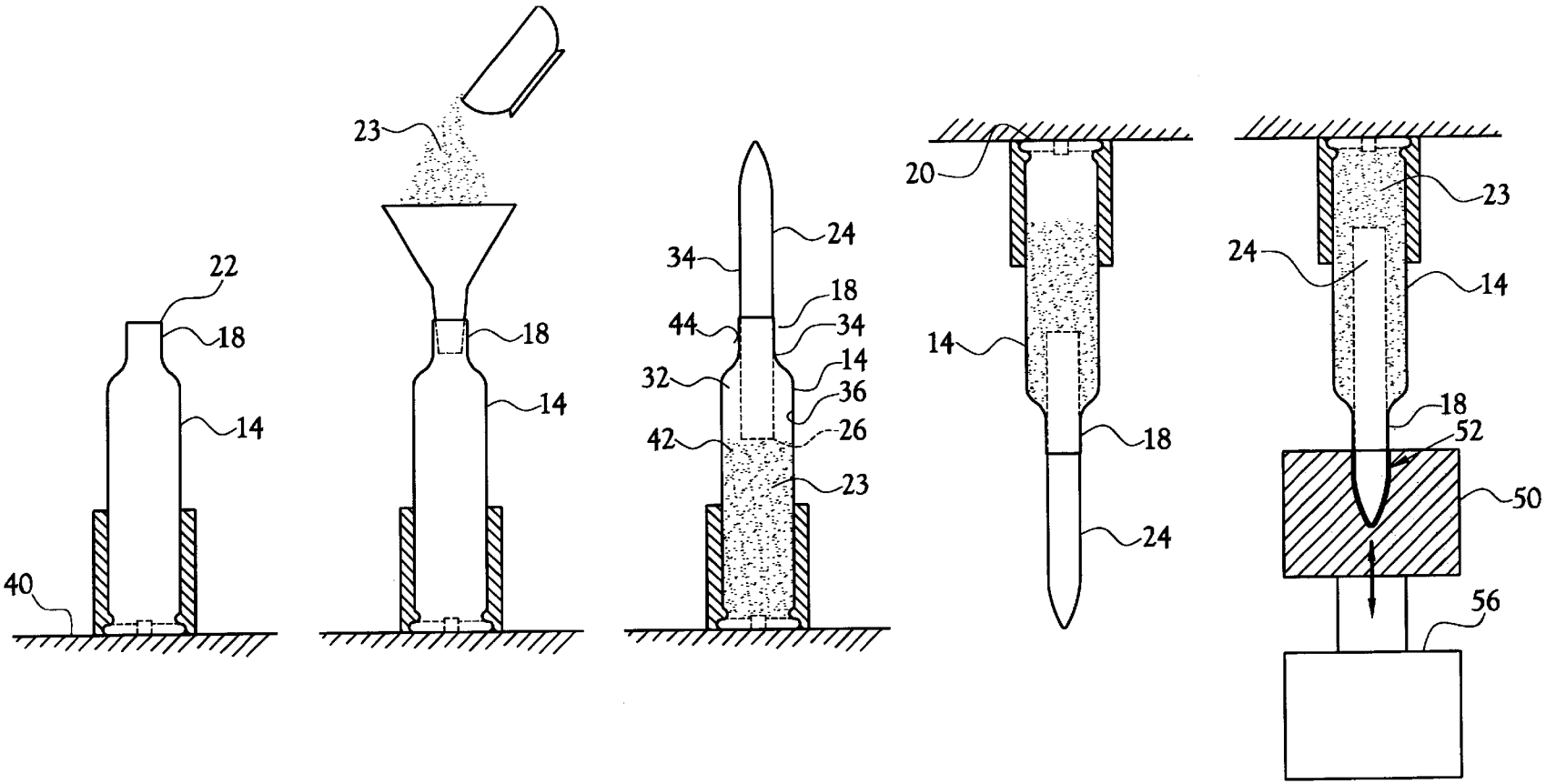
FIGS. 2A–2E constitute a representation of one embodiment of the method of the present invention, FIG. 2E being a sectioned plan view.

In the embodiment of the present method depicted in FIGS. 2A–2E, the case 14 of a cartridge is mounted upright on a supporting surface 40 with its open end 22 opening upwardly. A measured quantity of a chosen gun powder 23 is introduced into the upright case. Thereupon, the trailing end 26 of the projectile 24 is inserted into the case, via the open end 22 and the neck 18 of the case, to a distance wherein the trailing end 26 of the projectile terminates short of the level 42 of the gun powder in the case. This distance is less than the desired full extent of insertion (seating) of the projectile within the case. The outer surface 34 of the partially inserted projectile and that portion of the inner wall surface 36 of the case define an open annular space 32 therebetween which is devoid of gun powder as seen in FIG. 2C. The fit between the outer surface 34 of the projectile and the inner surface 44 of the neck provides for frictional engagement therebetween as will preclude the projectile from falling out of the case during subsequent manufacturing operations. Thereupon, the case is inverted so that the closed end of the case is directed vertically upward (FIG. 2D). This action results in the gun powder flowing, by gravity, into and substantially filling the annular space between the projectile and the case. Further, this action results in evacuation of gun powder from that volume of the case adjacent the closed end thereof and leaving open space into which the projectile may be moved without materially disturbing the gun powder remaining between the trailing end of the projectile and the closed end of the case. Thereupon, the projectile is further inserted into the case to the extent required to obtain full seating of the projectile within the case and establishment of the desired OAL of the cartridge. This action, in the depicted embodiment, gently radially displaces, but does not physically destroy or alter the shape of, the individual particles of gun powder (FIG. 2E). As noted, this action results in the definition of an annular space between the inner wall of the case and the outer surface of that portion of the projectile which projects inwardly of the case and beyond the terminal end of the neck. After the projectile has been inserted into the case to the extent required to develop the OAL 48 of the cartridge, (ie., fully seated), as desired, the open end of the cartridge may be crimped against the outer circumference of the projectile to anchor the projectile in the case. The completed cartridge is recovered.

In one specific application of the method of the present invention, cartridges of 5.56 mm caliber were manufactured with a target muzzle velocity of between about 1300 and about 1400 fps. In this example, a standard 5.56 mm brass metal cartridge case manufactured by Winchester Division of Olin Corporation of East Alton, Ill. was mounted upright with the open end of the case opening vertically upwardly. This case measured 1.760 inches in length and included a primer identified as CCI BR-4 from Blount Incorporated of Lewiston, Id. Sixteen grains of N 170 gun powder from Vihtavuori Oy of Finland was measured and poured into the open end of the case. The particles of this powder were of the extruded (grain) type. Thereafter, a 5.56 mm projectile which had been fabricated by cold-compacting in a die a mixture of about 97%, by weight, tungsten powder and about 3%, by weight, of tin powder, was selected for seating in the case. This projectile was of a length of 1.170 inches, weighed about 150 grains, and had a density of about 95 gm/cc. The trailing end of this projectile was inserted through the open end and neck of the case to a distance just short of the level of the gun powder disposed within the case. In this example, approximately 0.487 inches of the projectile projected inwardly of the case beyond the terminal end of the neck of the case and defined an annular space between the inner wall surface of the case and the outer surface of that portion of the projectile which projected inwardly beyond the inboard terminal end of the neck. This annular space was devoid of gun powder. The frictional fit between the outer surface of the projectile and the inner surface of the neck was sufficient to prevent the projectile from falling out of the case during subsequent handling of the cartridge during the manufacturing process.

Thereafter, the case, containing the gun powder and the partly seated projectile was inverted so that the closed end of the case was disposed vertically above the projectile as depicted in FIG. 2D. The process of inverting the incompletely formed cartridge caused the gun powder to flow, by gravity, into, and to fill, the annular space between the projectile and the case wall. In this example, a portion of the gun powder also covered the trailing end of the projectile. In the course of inverting the case, the leading end of the projectile was inserted into a die 50 having a die cavity 52 which geometrically matched the ogive on the leading end of the projectile (FIG. 2E). Employing mechanically generated pressure 56, the leading end of the projectile was urged into its fully seated attitude within the case. In the present instance, the projectile was inserted into the case to the extent that the OAL of the cartridge was 2.250 inches.

5.56 mm cartridges manufactured as described hereinabove were fired in a military M-16 rifle. The rifle was fired in both the semiautomatic and in the automatic modes. All the cartridges fed properly from the magazine of the rifle into the firing chamber of the rifle. The muzzle velocity of the projectiles fired from the rifle averaged about 975 fps, with a mean deviation of about 25 fps, indicating a muzzle velocity of all of the present projectiles well within the target muzzle velocity range of between about 950 and 1000 fps.

In a further example, the same 5.56 mm cartridge was manufactured employing 12.6 grains of gun powder, identified as N-170 from Vihtavuori, Oy of Finland. These cartridges were intended to be fired at subsonic velocities. In test firing of these latter cartridges from an M-16 rifle, the muzzle velocity of each the cartridges was in the subsonic range, with a mean deviation of about 25 fps. Further, these cartridges produced sufficient energy to consistently operate the bolt action of this gun.

Further, the present inventor has found that ensuring the presence of gun powder in the space between the trailing end of the projectile and the closed end of the case, and in the annular space between the case wall and the projectile, provides for uniform development of gas buildup within the case upon firing of the cartridge. This desirable effect enhances the consistency of muzzle velocity of the projectiles fired from cartridge to cartridge of a given caliber. This effect is especially desirable when one is manufacturing cartridges that are intended to propel the projectile from the gun at a subsonic muzzle velocity.

Whereas the present invention has been described in part by identifying specific materials of construction and specific embodiments of various aspects of the invention, it is intended that the invention be limited only as set forth in the claims appended hereto. For example, whereas the projectile depicted herein includes an ogive leading end, the projectile could exhibit a rounded end, a hollow point, or even a concavity in the leading end. Further, whereas there is described a "two-stage" insertion of the projectile into the case, it is permissible to employ three or more stages, if desired, to achieve the desired extent of insertion of the projectile into the case.

What is claimed:

1. A method for the manufacture of a gun ammunition cartridge including a case having a generally cylindrical body portion, a neck including an inboard terminal end, a closed end, an opposite and open end, and a quantity of gun powder disposed within the case, the open end of the case receiving and being closed by a generally cylindrical projectile having a trailing end and a leading end comprising the steps of positioning said case in an upright position with its open end opening upwardly thereof, introducing a measured quantity of gun powder into the interior of said case, said quantity of gun powder being less than the quantity of gun powder required to completely fill said case whereby said gun powder assumes a level within the case, inserting said trailing end into said case through said neck a distance whereby said trailing end projects inwardly of the interior of said case beyond the inboard terminal end of said neck and terminates short of the level of said gun powder within said case, and in combination with the body portion of said case defines an annular space therebetween which is devoid of gun powder, thereafter, inverting said case whereby said closed end thereof is disposed upwardly and said gun powder flows by gravity into said annular space, thereafter, inserting said projectile further into said case by a distance sufficient to provide a target overall length of the cartridge, and thereafter, recovering the cartridge.

2. The method of claim 1 and including the step of crimping said open end of said case about the circumference of said projectile.

3. The method of claim 1 wherein said projectile comprises a cold compacted mixture of tungsten metal powder and a metal powder that is lighter than tungsten.

4. The method of claim 3 wherein said metal powder that is lighter than tungsten is either tin metal powder or lead metal powder.

* * * * *